United States Patent [19]

Bornemann et al.

[11] Patent Number: 4,518,262

[45] Date of Patent: May 21, 1985

[54] MIXER FOR CONTINUOUSLY MIXING GRANULAR TO POWDERY MATERIALS

[75] Inventors: Hans-Joachim Bornemann, Vellmar; Horst Zlab, Malsfeld, both of Fed. Rep. of Germany

[73] Assignee: Thyssen Industrie Aktiengesellschaft, Essen, Fed. Rep. of Germany

[21] Appl. No.: 634,876

[22] Filed: Jul. 26, 1984

Related U.S. Application Data

[63] Continuation-in-part of Ser. No. 343,289, Jan. 27, 1982, abandoned.

[30] Foreign Application Priority Data

Feb. 14, 1981 [DE] Fed. Rep. of Germany ... 8104051[U]

[51] Int. Cl.[3] ..... B01F 15/02

[52] U.S. Cl. ..... 366/156; 366/144; 366/181; 366/186

[58] Field of Search ..... 366/156, 144, 149, 148, 366/146, 134, 177, 181, 182, 186, 194, 195, 196, 50, 77

[56] References Cited

U.S. PATENT DOCUMENTS

| | | | |
|---|---|---|---|
| 44,836 | 10/1864 | Neal | 366/307 |
| 729,806 | 6/1903 | Stoveken | 366/307 |
| 2,074,988 | 3/1937 | O'Brien et al. | 366/186 X |
| 2,148,998 | 1/1939 | Sackett | 366/144 X |
| 3,186,602 | 6/1965 | Ricciardi | 366/294 X |
| 3,239,878 | 7/1966 | Ahlefeld, Jr. | 366/194 X |
| 4,201,484 | 5/1980 | Sasiela et al. | 366/186 X |
| 4,269,582 | 5/1981 | Mella | 366/77 X |
| 4,367,954 | 1/1983 | Ganz | 366/156 |
| 4,443,109 | 4/1984 | Watts | 366/156 |

FOREIGN PATENT DOCUMENTS

| | | | |
|---|---|---|---|
| 729227 | 12/1942 | Fed. Rep. of Germany | 366/186 |

*Primary Examiner*—Robert W. Jenkins

*Attorney, Agent, or Firm*—Becker & Becker, Inc.

[57] ABSTRACT

A high speed mixer for continuously mixing granular to powdery materials. The mixer includes a stationary, essentially cylindrical container with blade-like mixing tools arranged coaxially therein and rotating at high speed. A supply opening is arranged in the container cover, and a discharge opening having a controllable discharge is arranged in the container wall in the transition region to the container bottom. A supply housing having a funnel-shaped lower portion is connected to the supply opening in the container cover, and extends parallel to the container axis. Laterally of the upper housing portion are arranged two worm conveyors. These worm conveyors are operable individually or in common. The discharge opening, which is provided with the controllable discharge, is on its outside likewise provided with an independent heatable or coolable worm conveyor. All of the conveying worms are drivable at variable speeds.

7 Claims, 3 Drawing Figures

MIXER FOR CONTINUOUSLY MIXING GRANULAR TO POWDERY MATERIALS

CROSS-REFERENCE TO RELATED APPLICATIONS

This application is a continuation-in-part application of U.S. patent application Ser. No. 343,289 filed Jan. 27, 1982, now abandoned.

BACKGROUND OF THE INVENTION

The present invention relates to a high speed mixer for continuously mixing granular to powdery materials, and comprises a stationary, essentially cylindrical container with blade-like mixing tools arranged coaxially therein and rotating at high speed. A supply opening is provided in the container cover, and a discharge opening having a controllable discharge is provided in the container wall in the transition region to the container bottom.

Such mixers predominantly have a tubular supply line which is connected with the supply opening and through which the materials to be mixed flow into the mixing container from the outside; such mixers also have a likewise tubular connecting piece connected to the discharge opening through which the mixed materials leave the container to the outside. A thorough mixing of the materials is attained in the container by the fast rotating mixing tools. The essential disadvantage with the previous embodiments, however, consists in that during the filling and emptying of the mixing container, so-called dead times arise, and that during the entire mixing time the total available motor capacity cannot be utilized due to the mixing behavior typical for the batch process.

It is therefore an object of the present invention to improve a mixer of the initially mentioned type in such a way that a higher throughput capacity is attained along with an energy-saving thorough mixing.

BRIEF DESCRIPTION OF THE DRAWINGS

This object, and other objects and advantages of the present invention, will appear more clearly from the following specification in connection with the accompanying drawings, in which.

SUMMARY OF THE INVENTION

Figure 1:
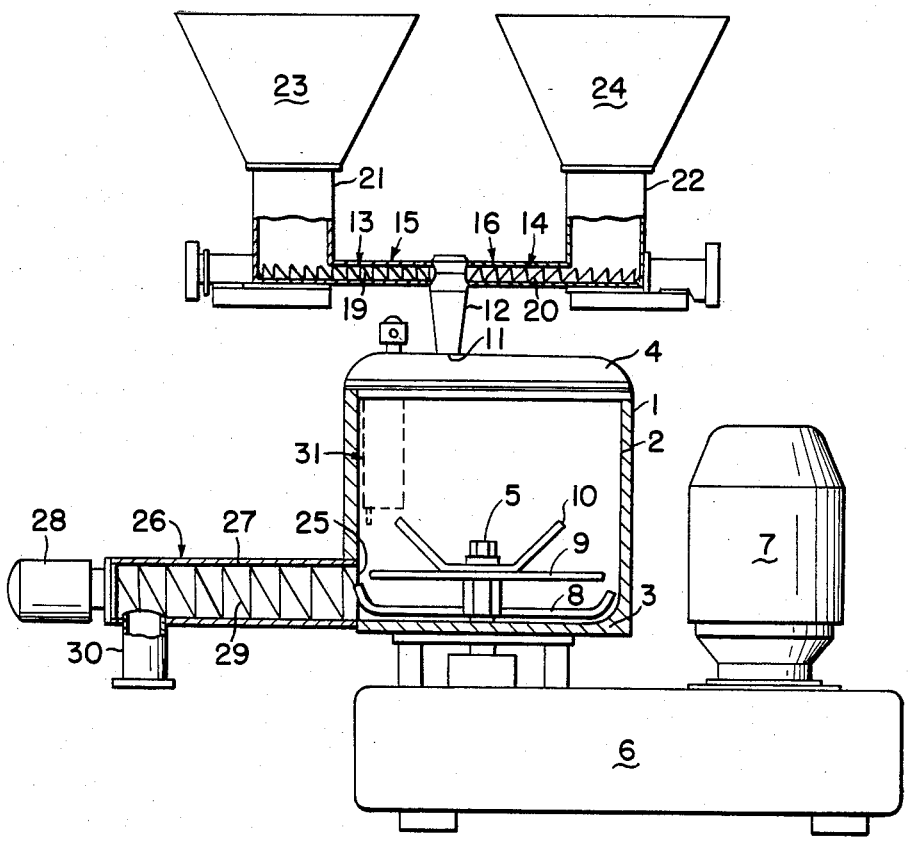
FIG. 1 is a schematic vertical section through a mixer having the innovative supply and discharge devices in accordance with the embodiment of the present invention.
Figure 2:
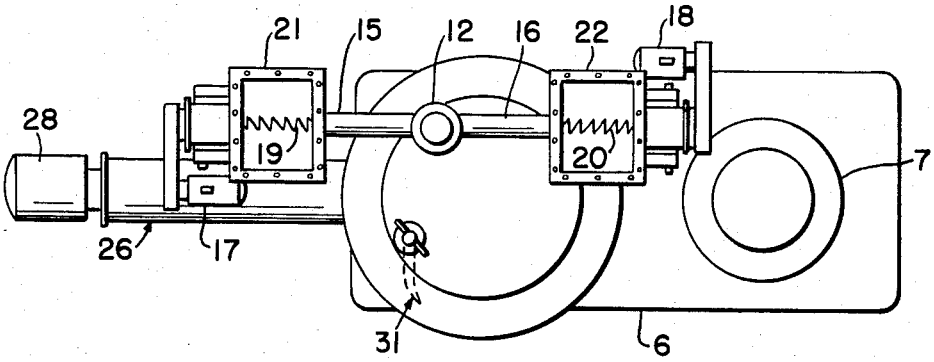
FIG. 2 is a plan view of the mixer shown in FIG. 1.

The mixer of the present invention is characterized primarily in that a supply housing having a funnel-shaped lower portion is connected to the outer side of the supply opening in the container cover and extends parallel to the container axis; laterally of the upper portion of this housing there are arranged two worm conveyors which are operable individually or in common; furthermore, the discharge opening, which is provided with the controllable discharge, is likewise provided on its outside with an independent heatable or coolable worm conveyor; all of the worm conveyors can be driven at variable speeds.

By way of this innovative embodiment, the supply and removal of materials into or out of the mixing container can be adapted to the respective conditions in order in this way to attain a higher throughput capacity. Additionally, it is possible, with an appropriate wall design of the mixing container, to use the mixer both for a continuous hot as well as cold preparation of mixtures of at least two materials.

To arrive at a practical design, it is expedient that each worm conveyor comprises a tubular stationary housing having a conveyor worm arranged therein which is rotatable by drive means, and that connecting pieces for supplying and removing the materials are connected to the housing and extend at right angles to the conveying direction.

A convexly shaped guide plate may be arranged above the discharge opening on the inner side of the mixing container wall; the convex configuration of the guide plate is in the direction of rotation of the mixing tools.

DESCRIPTION OF PREFERRED EMBODIMENTS

Referring now to the drawings in detail, the mixer comprises a stationary, essentially cylindrical container 1. The container has a wall 2 and is closed at its lower end by a bottom 3 connected to the wall 2; at the top the container is closed by a removable cover or lid 4. The container wall 2 may be embodied as a cooling jacket or a heating jacket. A shaft 5 is centrally journalled in the container bottom 3. Underneath the mixing container 1, which is arranged vertically on a machine frame 6, the shaft 5, which is substantially vertical, is connected via a speed controllable drive with an electric motor 7, which is likewise secured to the machine frame 6. Blade-like mixing tools 8, 9 and 10 are secured, in three superimposed planes, on that part of the shaft 5 which projects into the mixing container 1; these tools 8, 9 and 10 may be arranged so as to be displaced by 90° with respect to each other. The mixing tools in the lowermost plane, on that side thereof which faces the container bottom, have a contour which corresponds essentially to the contour of the container bettom, whereas the mixing tools arranged in the planes located thereabove extend radially in the rotational plane, or they have their outer free ends inclined upwardly.

A supply or feeding opening 11 is located in the container cover or lid 4, to the outer side of which a supply housing 12 is connected; the lower end of the housing 12 is funnel shaped. Two worm or screw conveyors 13 and 14 are fastened laterally to the upper end of this housing, which extends parallel to the container axis; these worm conveyors 13 and 14 each comprise a tubular housing 15 or 16 within which is arranged a conveyor worm 19 or 20, each having its own drive with a motor 17 or 18. However, in place of only two supply worm conveyors, it is also possible to provide several such supply worm conveyors.

Each housing 15, 16 surrounding the conveyor worm 19, 20 is connected by means of a pipe section or connecting piece 21, 22 to a material storage means or reservoir 23, 24 located above the worm conveyor 13, 14. It is, however, also possible to connect the tubular pipe sections 21 or 22 not to the storage means, but rather to preceding mixer means.

A discharge opening 25 is located in the transition region between the mixer container wall 2 and the container bottom 3, with the bottom of the opening 25 lying in the same plane as the bottom of the container 1. The discharge of the opening 25 is controllable by means of an independent worm conveyor 26 which is connected to the outside of the opening 25. This worm conveyor 26, which serves to withdraw the mixed materials from the mixing container 1, can be selectively heated or cooled and, like the worm conveyors 13 and 14 provided for supplying to the container 1 the materials to be mixed, comprises a tubular housing 27 with a conveyor worm 29 located therein which has its own drive with a motor 28. The tubular heatable or coolable housing is provided with a downwardly directed tubular pipe section 30 through which the mixed materials leave the worm conveyor.

The worm conveyor 26 effects control of the discharge of the opening 25 as follows. In order to prevent discharge from the opening 25, i.e. in order to effect to close the opening 25, the conveyor worm 29, during mixing of material in the container 1, is turned counter to the direction of rotation which exists during discharge. The direction of rotation of the conveyor worm 29 is reversed only after the desired end temperature is obtained, so that material can then be discharged from the container 1 through the opening 25.

A guide plate 31 is fastened to the inside of the container wall 2; this guide plate has a convex configuration in the rotational direction of the blade-like mixing tools and is arranged in the mixing container 1, in vertical projection, above the discharge opening 25 without affecting the opening cross section. The brief return or reverse movement of the materials to be mixed effected hereby during the mixing process occurs also between the blade-like mixing tools, so that the materials are continuously kept in an orderly mixing movement, and an extraordinarily thorough mixing occurs. Severe, localized overheating is accordingly avoided.

Figure 3:
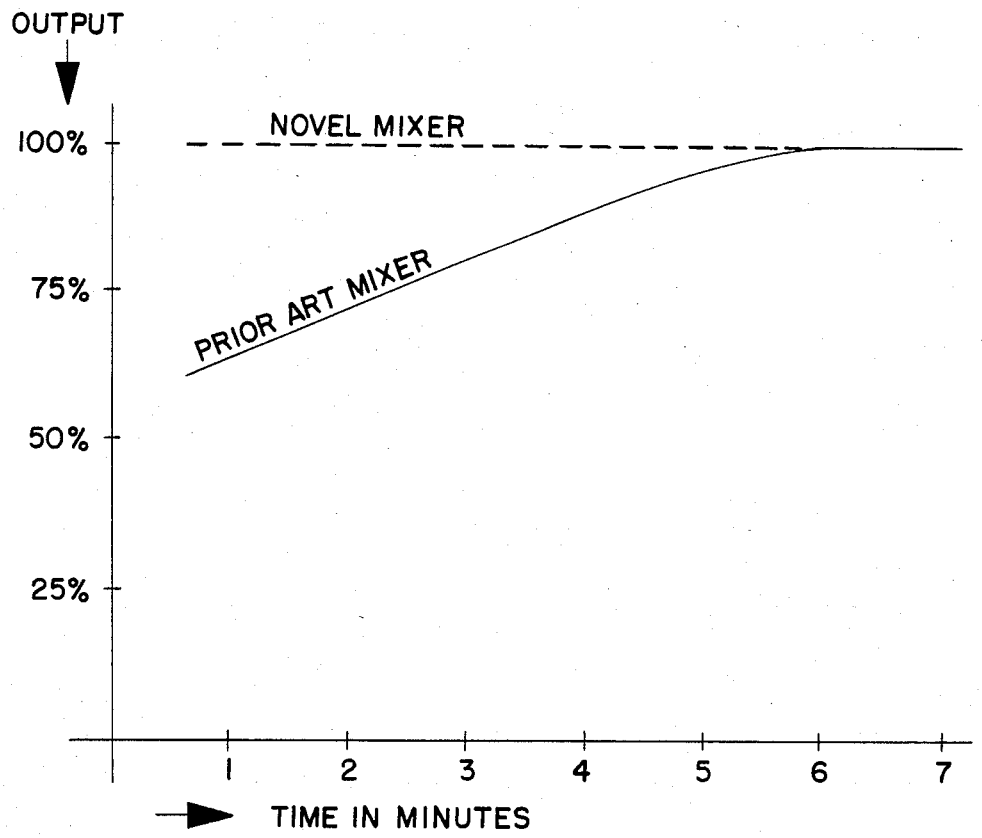
FIG. 3 is a graph to illustrate the characteristics of the mixer of the present invention compared with those of a previous mixer.

In the graph of FIG. 3, the mixing times are plotted on the abscissa, and the output or power consumption is plotted on the ordinate.

The curve for the prior art operation is represented by a solid line, and the curve for the innovative operation is represented by a dashed line. The attainable gain in time and energy with the innovative continuous operation as compared with the previous batch process is apparent from the surface area between the solid and dashed lines. Note that the power consumption with the inventive mixer is 100%; i.e., the drive motor of the inventive mixer is constantly loaded or utilized to 100%.

The initial advantages obtained with the inventive mixer are similar to those obtained with a batch-type mixer, and include utilization of a vortex mixing pattern and fluidization of the material in order to achieve a very homogeneous mixture in a very short period of time. Furthermore, due to the high frictional input of the mixing blades, the temperature of the product being mixed is elevated, resulting in certain specific advantages in the processing of various materials.

By replacing the normal discharge plug of a batch-type mixer with a screw conveyor, material can be withdrawn from the bottom of the inventive mixer at a controlled rate while fresh material is simultaneously fed into the mixing container through the cover thereof. As a result, it is possible to control the residence time in the mixer, and the temperature at which the material being mixed is maintained. Rather than a batch mode of operation, a continuous mode of operation is now provided.

The inventive mixer operates as follows. In a typical mixing sequence, the mixing container would be charged with material, and the screw conveyor would not be running. After the proper amount of material has been added to the container, the mixer would be run as if it were a batch-type mixer. After the mixer has run for a given length of time, the required temperature set point would be achieved, whereupon the screw conveyor would begin to discharge the material while fresh material was fed through the cover into the mixing container. By controlling the feed and discharge rates, the appropriate temperature can be maintained, and material can be processed continuously.

The advantages of the inventive continuous mode of operation include a substantial reduction in energy required to process a given amount of material, and significantly higher throughputs. For example, one heretofore known mixer which operates in a batch mode has an estimated throughput of 205 Kg per hour. In contrast, the inventive mixer has an estimated throughput that is at least three times as great yet utilizes a motor having the same horsepower.

Thus the inventive mixer not only offers savings in energy, but also in capital equipment for a given throughput, since a mixer of approximately one-third the volumetric capacity can be utilized to achieve the required throughput.

It should be noted at this point that the inventive high-speed mixer is suitable for preparing synthetic materials in temperature ranges where the heretofore known mixers, including the mixer of U.S. Pat. No. 4,201,484, cannot operate. This temperature range includes, in particular, final temperatures of the material being mixed of approximately 120° to 150° C. It should also be noted that the mixing tools of the present invention rotate at a peripheral speed of up to 40 meters per second. Not only do the mixing tools produce frictional heat, they also provide dispersion of the material. Controlling the speed of rotation of the discharge conveyor screw 29 serves not only for control of the extent of filling of the mixing container, but also indirectly for the control of the power consumption, which in turn determines the frictional heat which is produced.

In contrast to heretofore known mixers, the mixer of the present invention is particularly suitable for processing synthetic materials. For example, during successful tests, rigid, semi-rigid, and flexible PVC have been processed. Polyethylene, polypropylene, polycarbonate, and thermoplastic rubbers have been processed, with various pigments being added for master batching. Dyes and pigments can be added with the inventive mixer to all synthetic materials. A major area of use is the addition of various additives and stabilizers to polyethylene and polypropylene. Successful tests have also been run in the area of fillers, with calcium carbonate, clay, and other fillers being coated with various materials, such as silanes and stearic acid. Expandable polystyrene can also be coated with stearic acid. Polyolefins and crosslinkable polyethylene can be prepared with the inventive mixer. These are, of course, but a few examples of possible applications of the inventive mixer. Furthermore, the inventive mixer is not necessarily limited to the plastics market. The inventive mixer should be applicable any time that dry materials are to be coated or mixed together, and an intimate mix is required.

Successful tests for producing warm mixtures of all types have been conducted in the temperature range of from approximately 60° C. to 150° C. for the final temperature of mixed material.

The present invention is, of course, in no way restricted to the specific disclosure of the specification and drawings, but also encompasses any modifications within the scope of the appended claims.

What we claim is:

1. A high speed mixer for continuously mixing granular to powdery materials, said mixer comprising:

a stationary and essentially cylindrical container having a substantially vertical central axis, a side wall which extends substantially parallel to said central axis, a cover connected to the top of said side wall, and a bottom connected to the bottom of said side wall via a transition region; said cover is provided with a feeding opening which leads to the interior of said container; said side wall, in said transition region to said bottom, is provided with a discharge opening which is in communication with the interior of said container, with the bottom of said discharge opening lying in the same plane as the bottom of said container; the discharge of said discharge opening can be controlled;

blade-like mixing tools which are arranged coaxially in said container, with said mixing tools each having an axis of rotation which is at least parallel to said central axis of said container, and hence is likewise substantially vertical; said mixing tools are rotatable at high speed;

a supply housing arranged externally of said container and in communication with said feeding opening, said supply housing extending parallel to said central axis of said container, and having a funnel-shaped lower portion;

two worm conveyors arranged laterally of and in communication with the upper portion of said supply housing for supplying material thereto, said conveyors being operatively connected to first drive means for driving them individually or in common; and a further worm conveyor, the bottom of which lies in the same plane as the bottom of said container and the bottom of said discharge opening; said further worm conveyor is disposed externally of said container and is in communication with said discharge opening of said side wall thereof for receiving mixed material therefrom, and for effecting said control of said discharge thereof via the speed and direction of rotation of said further worm conveyor, with the latter being adapted to selectively open and close off said discharge opening; said further worm conveyor being operatively connected to second drive means for driving same; said first and second drive means being adapted to be driven at variable speeds and continuously during operation of said mixing tools in said container to effect said continuous mixing of materials.

2. A high speed mixer according to claim 1, in which each of said worm conveyors and said further worm conveyor comprises a stationary tubular housing in which is disposed a conveyor worm which is rotatable by means of the pertaining drive means; each stationary housing is provided with a respective pipe section which is in communication with the associated conveyor worm for respectively supplying material thereto and removing mixed material therefrom, said pipe sections extending at right angles to the respective conveying direction.

3. A high speed mixer according to claim 2, which includes a guide plate which has a convex configuration and which is disposed in said container, on said side wall, above said discharge opening; said convex configuration is in the direction of rotation of said mixing tools.

4. A high speed mixer according to claim 1, for use in connection with the mixing of synthetic materials having an end temperature of said mixed material in said container in the range of from ambient temperature to 150° C.

5. A high speed mixer according to claim 4, for use in connection with the mixing of synthetic materials having an end temperature of from 60°–150° C.

6. A high speed mixer according to claim 4, for use in connection with the mixing of synthetic materials having an end temperature of from 110°–150° C.

7. A high speed mixer according to claim 4, in which said synthetic materials include PVC and polyethylene.

* * * * *